US011261667B2

(12) United States Patent
Peters

(10) Patent No.: US 11,261,667 B2
(45) Date of Patent: Mar. 1, 2022

(54) SELF-ADJUSTING DIRECTIONAL DRILLING APPARATUS AND METHODS FOR DRILLING DIRECTIONAL WELLS

(71) Applicant: Volker Peters, Wienhausen (DE)

(72) Inventor: Volker Peters, Wienhausen (DE)

(73) Assignee: BAKER HUGHES, A GE COMPANY, LLC, Houston, TX (US)

( * ) Notice: Subject to any disclaimer, the term of this patent is extended or adjusted under 35 U.S.C. 154(b) by 409 days.

(21) Appl. No.: 14/667,026

(22) Filed: Mar. 24, 2015

(65) Prior Publication Data

US 2016/0281431 A1 Sep. 29, 2016

(51) Int. Cl.

| | |
|---|---|
| ***E21B 7/06*** | (2006.01) |
| ***E21B 17/20*** | (2006.01) |
| ***E21B 41/00*** | (2006.01) |
| ***E21B 44/00*** | (2006.01) |
| ***E21B 44/04*** | (2006.01) |
| ***E21B 47/00*** | (2012.01) |
| ***E21B 47/024*** | (2006.01) |

(52) U.S. Cl.

CPC ..... *E21B 7/067* (2013.01); *E21B 7/06* (2013.01); *E21B 17/20* (2013.01); *E21B 41/00* (2013.01); *E21B 44/00* (2013.01); *E21B 44/04* (2013.01); *E21B 47/00* (2013.01); *E21B 47/024* (2013.01)

(58) Field of Classification Search

CPC ..... E21B 7/067; E21B 7/06; E21B 17/20

See application file for complete search history.

(56) References Cited

U.S. PATENT DOCUMENTS

| | | | | |
|---|---|---|---|---|
| 3,380,543 A | | 4/1968 | Vincent | |
| 3,586,116 A | * | 6/1971 | Tiraspolsky | E21B 7/067 175/74 |
| 4,522,272 A | | 6/1985 | Beimgraben | |

(Continued)

FOREIGN PATENT DOCUMENTS

| | | | | |
|---|---|---|---|---|
| EP | 0015137 A1 | * | 9/1980 | E21B 7/068 |
| GB | 2442303 A | | 4/2008 | |

(Continued)

OTHER PUBLICATIONS

PCT International Search Report and Written Opinion; International Application No. PCT/US2016/023886; International Filing Date: Mar. 24, 2016; dated Jun. 27, 2016; pp. 1-13.

(Continued)

*Primary Examiner* — Waseem Moorad
*Assistant Examiner* — Neel Girish Patel
(74) *Attorney, Agent, or Firm* — Cantor Colburn LLP

(57) ABSTRACT

An apparatus for drilling curved and straight sections of a wellbore is disclosed that in one non-limiting embodiment includes a drilling assembly configured to include a drill bit at an end thereof that can be rotated by a drive in the drilling assembly and by the rotation of the drilling assembly, and wherein the drilling assembly includes: a deflection device that (i) tilts a section of the drilling assembly within a selected plane when the drilling assembly is substantially rotationally stationary to allow drilling of a curved section of the wellbore by rotating the drill bit by the drive; and (ii) straightens the section of the drilling assembly when the drilling assembly is rotated to allow drilling of a straight section of the wellbore.

21 Claims, 4 Drawing Sheets

(56) References Cited

U.S. PATENT DOCUMENTS 4,655,299 A * 4/1987 Schoeffler ..... E21B 7/067 175/38
4,811,798 A * 3/1989 Falgout, Sr. ..... E21B 7/068 175/256
4,884,643 A * 12/1989 Wawrzynowski ..... E21B 7/067 175/74
4,895,214 A * 1/1990 Schoeffler ..... E21B 7/062 175/256
5,048,621 A 9/1991 Bailey et al.
5,117,927 A 6/1992 Askew
5,154,243 A 10/1992 Dudman
5,181,576 A 1/1993 Askew et al.
5,195,754 A 3/1993 Dietle
5,259,467 A * 11/1993 Schoeffler ..... E21B 23/04 175/322
5,269,385 A 12/1993 Sihlis
5,314,032 A 5/1994 Pringle et al.
5,423,389 A * 6/1995 Warren ..... E21B 7/04 175/75
5,899,281 A 5/1999 Gynz-Rekowski
5,941,323 A 8/1999 Warren
6,203,435 B1 3/2001 Falgout, Sr.
6,598,687 B2 * 7/2003 Eppink ..... E21B 4/006 175/73
6,659,201 B2 * 12/2003 Head ..... E21B 7/067 175/61
7,204,325 B2 4/2007 Song et al.
7,287,604 B2 * 10/2007 Aronstam ..... E21B 7/062 175/61
7,392,857 B1 7/2008 Hall et al.
2003/0127252 A1 7/2003 Downton et al.
2005/0109542 A1 5/2005 Downton
2006/0243487 A1 * 11/2006 Turner ..... E21B 7/062 175/26
2007/0114068 A1 * 5/2007 Hall ..... E21B 7/064 175/61
2008/0149394 A1 * 6/2008 Downton ..... E21B 17/1014 175/73
2008/0158006 A1 7/2008 Pisoni et al.
2009/0133930 A1 5/2009 Thorp et al.
2009/0166089 A1 7/2009 Millet
2009/0205867 A1 8/2009 Reckmann et al.
2009/0266611 A1 * 10/2009 Camp ..... E21B 7/067 175/45
2011/0308858 A1 * 12/2011 Menger ..... E21B 7/067 175/24
2012/0018225 A1 1/2012 Peter et al.
2013/0043076 A1 * 2/2013 Larronde ..... E21B 7/062 175/61
2014/0110178 A1 4/2014 Savage et al.
2015/0176344 A1 6/2015 McLoughlin et al.
2016/0069139 A1 * 3/2016 Sugiura ..... E21B 7/06 175/61
2017/0067333 A1 3/2017 Peters
2017/0074041 A1 3/2017 Peters
2017/0074042 A1 3/2017 Peters et al.

FOREIGN PATENT DOCUMENTS

WO 2013122603 A1 8/2013
WO WO-2013122603 A1 * 8/2013 ..... E21B 7/067
WO 2016057445 A1 4/2016

OTHER PUBLICATIONS

PCT International Search Report and Written Opinion; International Application No. PCT/US2017/052654; International Filing Date: Sep. 21, 2017; dated Jan. 8, 2018; pp. 1-17.
PCT International Search Report and Written Opinion; International Application No. PCT/US2017/052652; International filing date: Sep. 21, 2017; dated Jan. 4, 2018; pp. 1-16.
PCT International Search Report and Written Opinion; International Application No. PCT/US2017/052655; International Filing Date: Sep. 21, 2017; dated Dec. 14, 2017; pp. 1-15.

* cited by examiner

SELF-ADJUSTING DIRECTIONAL DRILLING APPARATUS AND METHODS FOR DRILLING DIRECTIONAL WELLS

BACKGROUND

1. Field of the Disclosure

This disclosure relates generally to drilling directional wellbores.

2. Background of the Art

Wellbores or wells (also referred to as boreholes) are drilled in subsurface formations for the production of hydrocarbons (oil and gas) using a drill string that includes a drilling assembly (commonly referred to as a "bottomhole assembly" or "BHA") attached to a drill pipe bottom. A drill bit attached to the bottom of the drilling assembly is rotated by rotating the drill string from the surface and/or by a drive, such as a mud motor in the drilling assembly. A common method of drilling curved sections and straight sections of wellbores (directional drilling) utilizes a fixed bend AKO mud motor to provide a selected bend to the drill bit to form curved sections of wells. To drill a curved section, the drill string rotation from the surface is stopped, the bend of the AKO is directed into the desired build direction and the drill bit is rotated by the mud motor. Once the curved section is complete, the drilling assembly including the bend is rotated from the surface to drill a straight section. Such methods produce uneven boreholes. The borehole quality degrades as the bend is increased causing effects like spiraling of the borehole. Other negative borehole quality effects attributed to the rotation of bent assemblies include drilling of overgauge boreholes, borehole breakouts, and weight transfer. Such apparatus and methods also induce high stress and vibrations on the mud motor components compared to drilling assembles without an AKO and create high friction between the drilling assembly and the borehole due to the bend contacting the borehole as the drilling assembly rotates. Consequently, the maximum build rate is reduced by reducing the angle of the bend of the AKO to reduce the stresses on the mud motor and other components in the drilling assembly. Such methods result in additional time to drill the wellbore and thus may drive expenses far higher. Therefore, it is desirable to provide drilling assemblies and methods for drilling curved wellbore sections with a bend and straight sections without a bend in the drilling assembly to reduce stresses on the drilling assembly components.

The disclosure herein provides apparatus and methods for drilling wellbores, wherein the drilling assembly includes a deflection device that self-adjusts to provide a desired tilt for drilling curved sections and straightens itself when the drilling assembly is rotated for drilling straight wellbore sections.

SUMMARY

In one aspect, an apparatus for drilling curved and straight sections of a wellbore is disclosed that in one non-limiting embodiment includes a drilling assembly configured to include a drill bit at an end thereof that can be rotated by a drive in the drilling assembly and by rotating the drilling assembly from a surface location, wherein the drilling assembly includes a deflection device that (i) tilts a section of the drilling assembly with respect to a selected axis or within selected plane when the drilling assembly is substantially stationary to allow drilling a curved section of the wellbore by rotating the drill bit by the drive; and (ii) straightens the lower section when the drilling assembly is rotated to allow drilling of a straight section of the wellbore.

In another aspect, a method of drilling a wellbore is disclosed that in one non-limiting embodiment includes: conveying a drilling assembly in the wellbore that includes a drive for rotating a drill bit, a deflection device that tilts the drilling assembly with respect to a selected axis or within a selected plane when the drilling assembly is substantially stationary and straightens the drilling assembly when the drilling assembly is rotated; maintaining the drilling assembly substantially stationary to enable the drilling assembly housing to tilt; applying a weight on the drill bit; and rotating the drill bit by the drive to drill a curved section of the wellbore.

Examples of the more important features of a drilling apparatus have been summarized rather broadly in order that the detailed description thereof that follows may be better understood, and in order that the contributions to the art may be appreciated. There are additional features that will be described hereinafter and which will form the subject of the claims.

BRIEF DESCRIPTION OF THE DRAWINGS

For a detailed understanding of the apparatus and methods disclosed herein, reference should be made to the accompanying drawings and the detailed description thereof, wherein like elements are generally given same numerals and wherein.

DETAILED DESCRIPTION OF THE DRAWINGS

In aspects, the disclosure herein provides a drilling assembly or BHA that includes a deflection device that initiates a tilt to enable drilling of curved sections of wellbores and straightens itself to enable drilling of straight (vertical and tangent) sections of the wellbores. Such a drilling assembly prevents or reduces borehole spiraling, reduces friction between the drilling assembly and the wellbore during drilling of straight sections, reduces stress on components of the drilling assembly, such as a downhole drive (such as a mud motor), and also allows for easy positioning of the drilling assembly for directional drilling. Such a drilling assembly allows drilling of straight sections without a bend in the drilling assembly when the drilling assembly is rotated and allows drilling a curved section when the drilling assembly is stationary (not rotated) while the drill bit is rotated with the downhole drive. In aspects, such drilling is achieved by using a self-adjusting articulation joint to create a tilt in the drilling assembly when the drill string and thus the drilling assembly is stationary (not rotating) and using a dampener to maintain the drilling assembly straight when the drilling assembly is rotated. In other aspects a force application device, such as a spring or a hydraulic device, may be utilized to initiate the tilt by applying a force into a hinged direction when the drilling assembly is not rotated.

Figure 1:
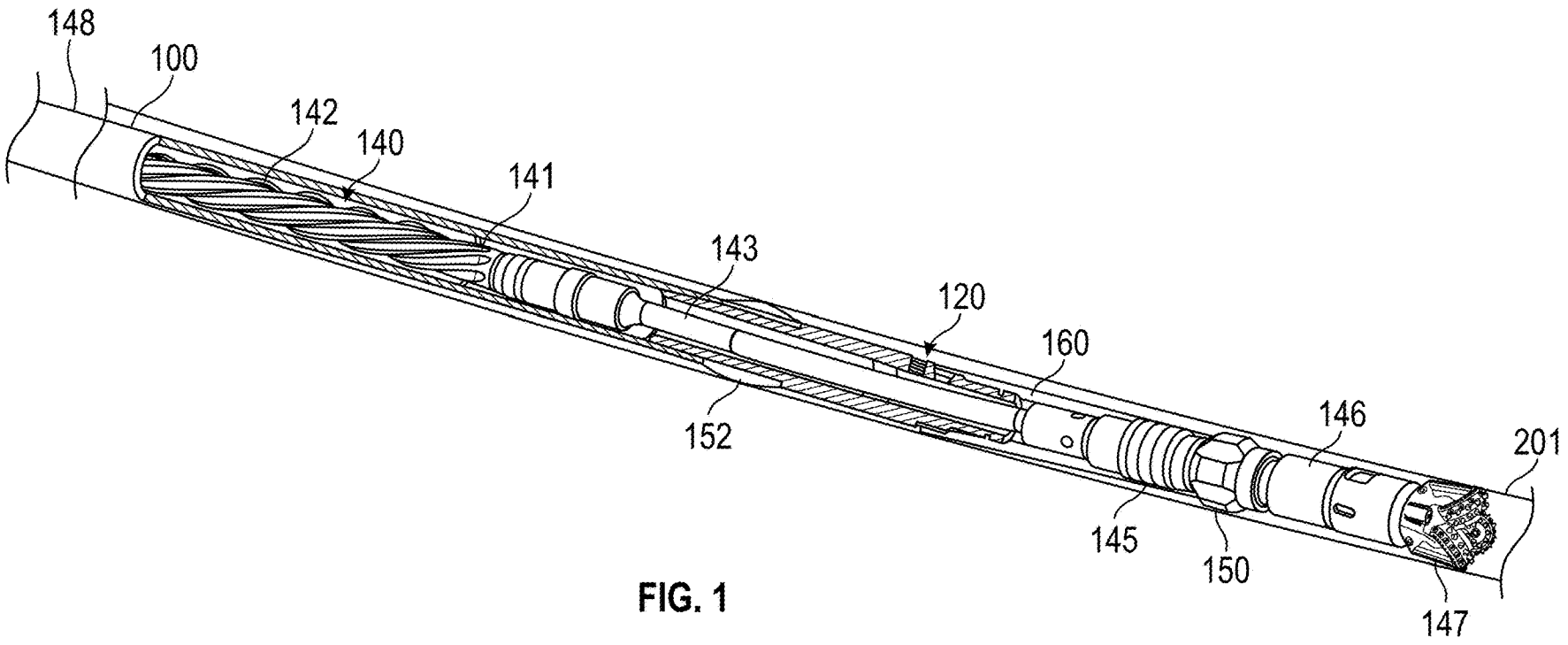
FIG. 1 shows a drilling assembly in a curved section of a wellbore that includes a deflection device or mechanism for drilling curved and straight sections of the wellbore, according to one non-limiting embodiment of the disclosure.

FIG. 1 shows a drilling assembly 100 in a curved section of a wellbore 101. In a non-limiting embodiment, the drilling assembly 100 includes a deflection device (also referred herein as a flexible device or a deflection mechanism) 120 for drilling curved and straight sections of the wellbore 101. The drilling assembly 100 further includes a downhole drive or drive, such as a mud motor 140 having a stator 141 and rotor 142. The rotor 142 is coupled to a transmission, such as a flexible shaft 143 that is coupled to another shaft 146 disposed in a bearing assembly 145. The shaft 146 is coupled to a drill bit 147. The drilling assembly 100 further includes a drill bit 147 that rotates when the rotor 142 of the mud motor 140 rotates due to circulation of a drilling fluid, such as mud, during drilling operations. The drilling assembly 100 is connected to a drill pipe 148, which is rotated from the surface to rotate the drilling assembly 100 and thus the drill bit 147. In the particular drilling assembly configuration shown in FIG. 1, the drill bit 147 may be rotated by rotating the drill pipe 148 and thus the drilling assembly 100 and/or the mud motor 140. The rotor 142 rotates the drill bit 147 when a fluid is circulated through the drilling assembly 100. The drilling assembly 100 further includes a deflection device 120. While in FIG. 1 the deflection device 120 is shown below the mud motor 140 (drive) and coupled to a lower section, such as housing or tubular 160 disposed over the bearing section 145, the deflection device 120 may also be located above the drive 140. In various embodiments of the deflection device 120 disclosed herein, the housing 160 tilts a selected amount along a selected plane to tilt the drill bit 147 along the selected plane to allow drilling of curved borehole sections. As described later in reference to FIGS. 2-6, the tilt is initiated when the drilling assembly 120 is stationary (not rotating) or substantially rotationally stationary. The curved section is then drilled by rotating the drill bit by the mud motor 140 without rotating the drilling assembly 120. The lower section 160 straightens when the drilling assembly is rotated, which allows drilling of straight wellbore sections. Thus, in aspects, the deflection device 120 provides a selected tilt in the drilling assembly 100 that allows drilling of curved sections when the drill pipe 148 and thus the drilling assembly is substantially rotationally stationary and the drill bit 147 is rotated by the drive 140. However when the drilling assembly 100 is rotated, such as by rotating the drill pipe 148 from the surface, the tilt straightens and allows drilling of straight borehole sections, as described in more detail in reference to FIGS. 2-6. In one embodiment, a stabilizer 150 is provided below the flexible device 120 (between the flexible device 120 and the drill bit 147) that initiates a bending moment in the deflection device 120 and also maintains the tilt when the drilling assembly 100 is not rotated and a weight on the drill bit is applied during drilling of the curved borehole sections. In another embodiment a stabilizer 152 may be provided above the deflection device 120 in addition to or without the stabilizer 150 to initiate the bending moment in the deflection device 120 and to maintain the tilt during drilling of curved borehole sections. In other embodiments, more than one stabilizer may be provided above and/or below the deflection device 120. Modeling may be performed to determine the location and number of stabilizers for optimum operation.

Figure 2:
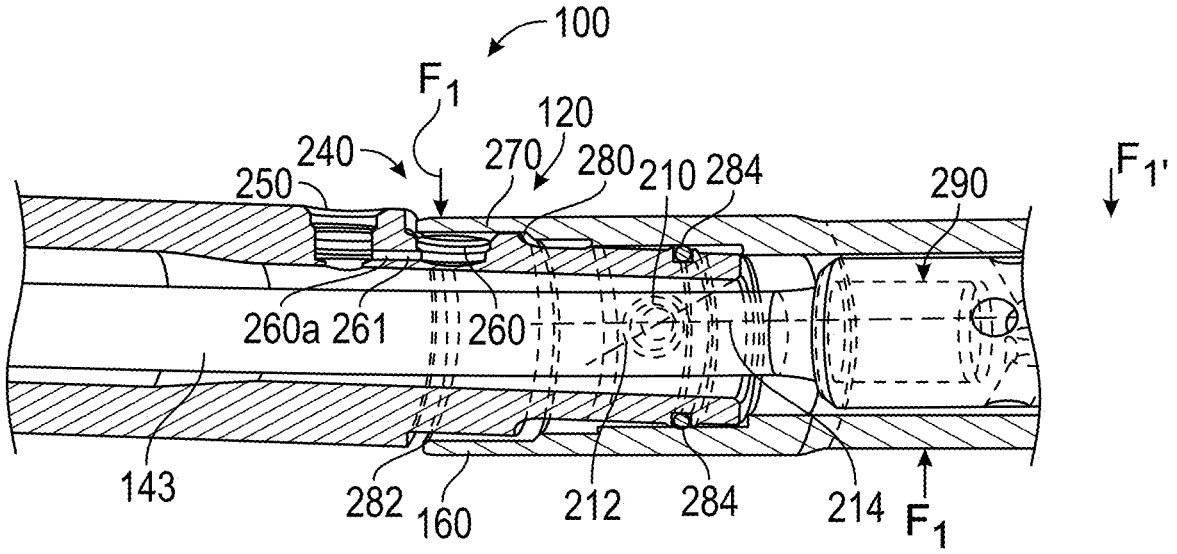
FIG. 2 shows the deflection device of the drilling assembly of FIG. 1 when the a lower section of the drilling assembly is tilted.

FIG. 2 shows a non-limiting embodiment of a deflection device 120 for use in a drilling assembly, such as the drilling assembly 100 shown in FIG. 1. Referring to FIGS. 1 and 2, in one non-limiting embodiment, the deflection device 120 includes a pivot member, such as a pin 210 having an axis 212 perpendicular to the longitudinal axis 214 of the drilling assembly 100, about which the housing 270 of a lower section 290 of the drilling assembly 100 tilts or inclines a selected amount relatively to the transmission 143 about the plane defined by the axis 212. The housing 270 tilts between a straight end stop 282 and an inclined end stop 280 that defines the maximum tilt. When the housing 270 of the lower section 290 is tilted in the opposite direction, the straight end stop 282 defines the straight position of the drilling assembly 100, where the tilt is zero. In such an embodiment, the housing 270 tilts only along a particular plane or radial direction. One or more seals, such as seal 284, is provided between the inside of the housing 270 and another member the drilling assembly 100 to seal the inside section of the housing 270 below the seal 284 from the outside environment, such as the drilling fluid.

Still referring to FIGS. 1 and 2, when a weight on the bit 147 is applied while the drill pipe 148 is substantially rotationally stationary, it will initiate a tilt of the housing 270 about the pin axis 212 of the pin 210. The stabilizer 150 below the flexible device 120 initiates a bending moment in the deflection device 120 and also maintains the tilt when the drill pipe 148 and thus the drilling assembly 120 is substantially rotationally stationary (not rotating) and a weight on the drill bit 147 is applied during drilling of the curved borehole sections. Similarly, stabilizer 152 in addition to or without the stabilizer 150 also initiates the bending moment in the deflection device 120 and maintains the tilt during drilling of curved borehole sections. In one non-limiting embodiment, a dampening device or dampener 240 may be provided to reduce or control the rate of increase of the tilt when the drilling assembly 100 is rotated. In one non-limiting embodiment, the dampener 240 may include a piston 260 and a compensator 250 in fluid communication with the piston 260 via a line 260*a* to reduce or control the rate of the tilt. Applying a force F1 on the housing 270 will cause the housing 270 and thus the lower section 290 to tilt about the pin axis 212. Applying a force F1' opposite to the direction of force F1 on the housing 270 causes the housing 270 and thus the drilling assembly 100 to straighten. The dampener may also be used to stabilize the straightened position of the housing 270 during rotation of the drilling assembly 100 from the surface. The operation of the dampening device 240 is described in more detail in reference to FIGS. 6A and 6B. Any other suitable device, however, may be utilized to reduce or control the rate of the bend of the drilling assembly 100 about the pin 210.

Figure 3:
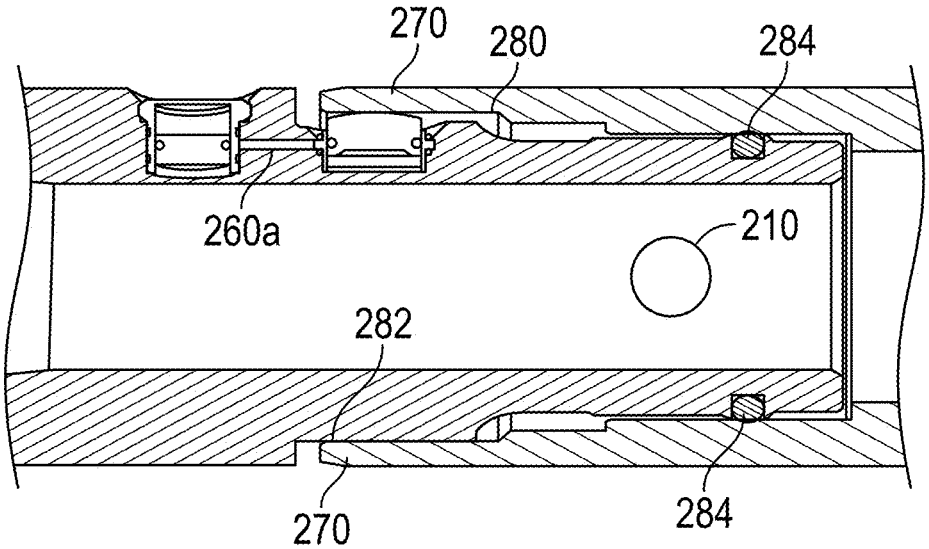
FIG. 3 shows the deflection device of the drilling assembly of FIG. 1 when the lower section of the drilling assembly is straight.

Referring now to FIGS. 1-3, when the drill pipe 148 is substantially rotationally stationary (not rotating) and a weight is applied on the drill bit 147, the deflection device will initiate a tilt of the drilling assembly 100 at the pivot 210 about the pivot axis 212. The rotating of the drill bit 147 by the downhole drive 140 will cause the drill bit 147 to initiate drilling of a curved section. As the drilling continues, the continuous weight applied on the drill bit 147 will continue to increase the tilt until the tilt reaches the maximum value defined by the inclined end stop 280. Thus, in one aspect, a curved section may be drilled by including the pivot 210 in the drilling assembly 100 with a tilt defined by the inclined end stop 280. If the dampening device 240 is included in the drilling assembly 100 as shown in FIG. 2, tilting the drilling assembly 100 about the pivot 210 will cause the housing 270 in section 290 to apply a force F1 on the piston 260, causing a fluid 261, such as oil, to transfer from the piston 260 to the compensator 250 via a conduit or path 260*a*. The flow of the fluid 261 from the piston 260 to the compensator 250 may be restricted to reduce or control the rate of increase of the tilt and avoid sudden tilting of the lower section 290, as described in more detail in reference to FIGS. 6A and 6B. In the particular illustrations of FIGS. 1 and 2, the drill bit 147 will drill a curved section upward. To drill a straight section after drilling the curved section, the drilling assembly 100 may be rotated 180 degrees to remove the tilt and then later rotated from the surface to drill the straight section. However, when the drilling assembly 100 is rotated, based on the positions of the stabilizers 150 and/or 152 and the well path, bending forces in the wellbore act on the housing 270 and exert forces in opposite direction to the direction of force F1, thereby straightening the housing 270 and thus the drilling assembly 100, which allows the fluid 161 to flow from the compensator 250 to the piston 260 causing the piston to move outwards. Such fluid flow may not be restricted, which allows the housing 270 and thus the lower section 290 to straighten rapidly (without substantial delay). The outward movement of the piston 260 may be supported by a spring either positioned in force communication with the piston 260 or the compensator 250. The straight end stop 282 restricts the movement of the member 270, causing the lower section 290 to remain straight as long as the drilling assembly 100 is being rotated. Thus, the embodiment of the drilling assembly 100 shown in FIGS. 1 and 2 provides a self-initiating tilt when the drilling assembly 120 is stationary (not rotated) or substantially stationary and straightens itself when the drilling assembly 100 is rotated. Although the downhole drive 140 shown in FIG. 1 is shown to be a mud motor, any other suitable drive may be utilized to rotate the drill bit 147. FIG. 3 shows the drilling assembly 100 in the straight position, wherein the housing 270 rests against the straight end stop 282.

Figure 4:
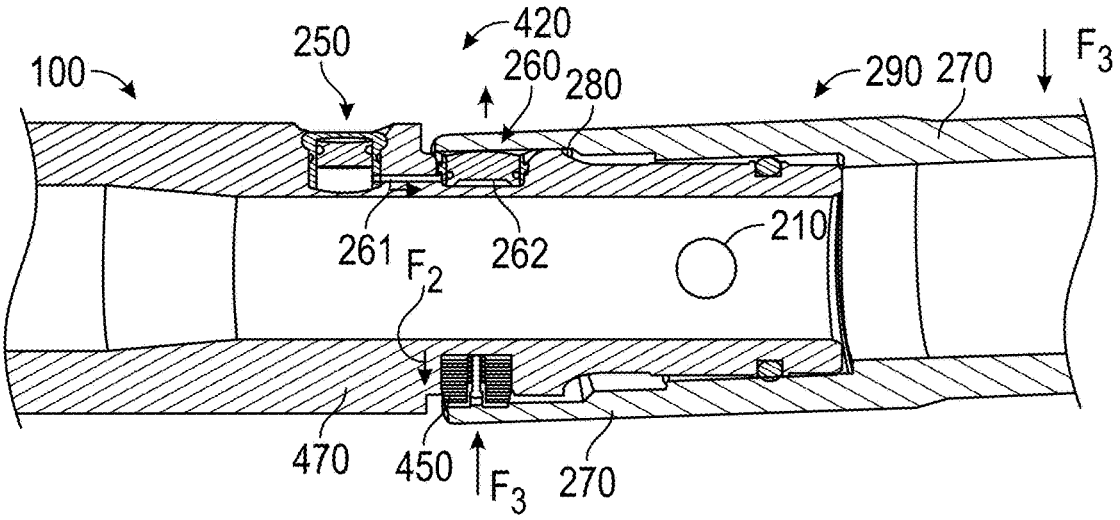
FIG. 4 shows a non-limiting embodiment of a deflection device that includes a force application device that initiates the tilt in a drilling assembly, such as the drilling assembly shown in FIG. 1.

FIG. 4 shows another non-limiting embodiment of a deflection device 420 that includes a force application device, such as a spring 450, that continually exerts a radially outward force F2 on the housing 270 of the lower section 290 to provide or initiate a tilt to the lower section 290. In one embodiment, the spring 450 may be placed between the inside of the housing 270 and a housing 470 outside the transmission 143. In this embodiment, the spring 450 causes the housing 270 to tilt radially outward about the pivot 210 up to the maximum bend defined by the inclined end stop 280. When the drilling assembly 100 is stationary (not rotating) or substantially rotationally stationary, a weight on the drill bit 147 is applied and the drill bit is rotated by the downhole drive 140, the drill bit 147 will initiate the drilling of a curved section. As drilling continues, the tilt increases to its maximum level defined by the inclined end stop 280. To drill a straight section, the drilling assembly 100 is rotated from the surface, which causes the borehole to apply force F3 on the housing 270, compressing the spring 450 to straighten the drilling assembly 100. When the spring 450 is compressed by application of force F3, the housing 270 relieves pressure on the piston 260, which allows the fluid 261 from the compensator 250 to flow back to piston 260 without substantial delay as described in more detail in reference to FIGS. 6A and 6B.

Figure 5:
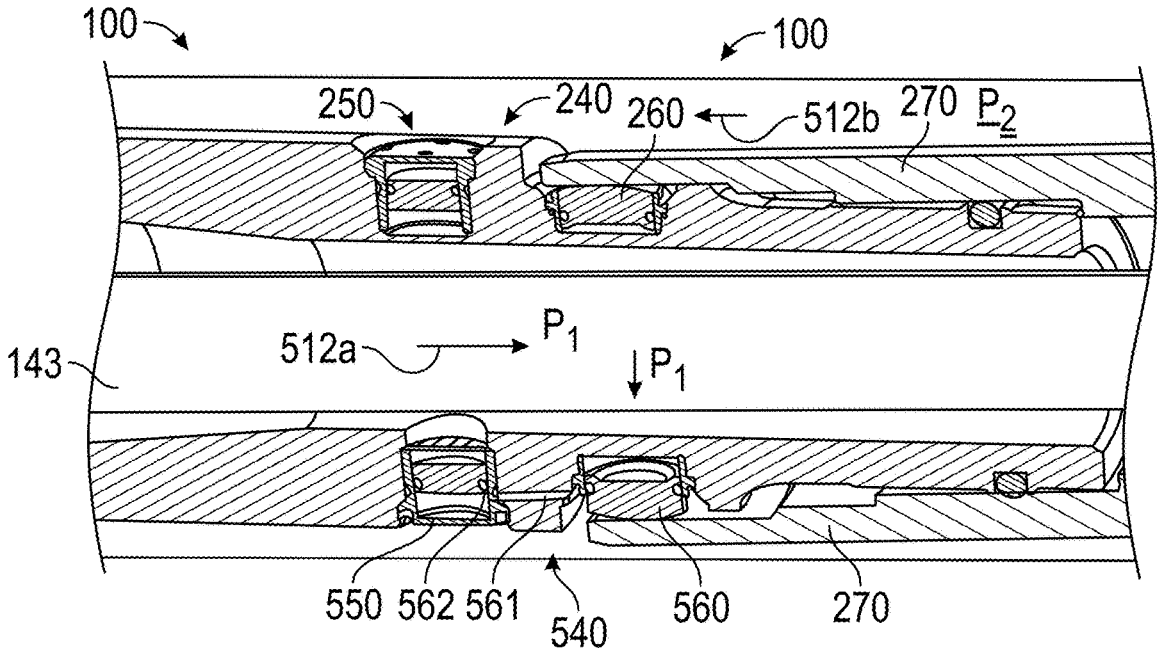
FIG. 5 shows another non-limiting embodiment of a hydraulic deflection device that initiates the tilt in a drilling assembly, such as the drilling assembly shown in FIG. 1.

FIG. 5 shows a non-limiting embodiment of a hydraulic force application device 540 to initiate a selected tilt in the drilling assembly 100. In one non-limiting embodiment, the device 540 includes a piston 560 and a compensation device or compensator 550. The drilling assembly 100 also may include a dampening device or dampener, such as dampener 240 shown in FIG. 2. The dampening device 240 includes a piston 260 and a compensator 250 shown and described in reference to FIG. 2. The device 540 may be placed 180 degrees from device 240. The piston 560 and compensator 550 are in hydraulic communication with each other. During drilling, a fluid 512*a*, such as drilling mud, flows under pressure through the drilling assembly 100 and returns to the surface via an annulus between the drilling assembly 100 and the wellbore as shown by fluid 512*b*. The pressure P1 of the fluid 512*a* in the drilling assembly 100 is greater (typically 20-50 bars) than the pressure P2 of the fluid 512*b* in the annulus. When fluid 512*a* flows through the drilling assembly 100, pressure P1 acts on the compensator 550 and correspondingly on the piston 560 while pressure P2 acts on compensator 250 and correspondingly on piston 260. Pressure P1 being greater than pressure P2 creates a differential pressure (P1-P2) across the piston 560, which pressure differential is sufficient to cause the piston 560 to move radially outward, which pushes the housing 270 outward to initiate a tilt. A restrictor 562 may be provided in the compensator 550 to reduce or control the rate of the tilt as described in more detail in reference to FIGS. 6A and 6B. Thus, when the drill pipe 148 is substantially rotationally stationary (not rotating), the piston 560 slowly bleeds the hydraulic fluid 561 through the restrictor 562 until the full tilt angle is achieved. The restrictor 562 may be selected to create a high flow resistance to prevent rapid piston movement which may be present during tool face fluctuations of the drilling assembly to stabilize the tilt. The differential pressure piston force is always present during circulation of the mud and the restrictor 562 limits the rate of the tilt. When the drilling assembly 100 is rotated, bending moments on the housing 270 force the piston 560 to retract, which straightens the drilling assembly 100 and then maintains it straight as long as the drilling assembly 100 is rotated. The dampening rate of the dampening device 240 may be set to a higher value than the rate of the device 540 in order to stabilize the straightened position during rotation of the drilling assembly 100.

Figure 6A:
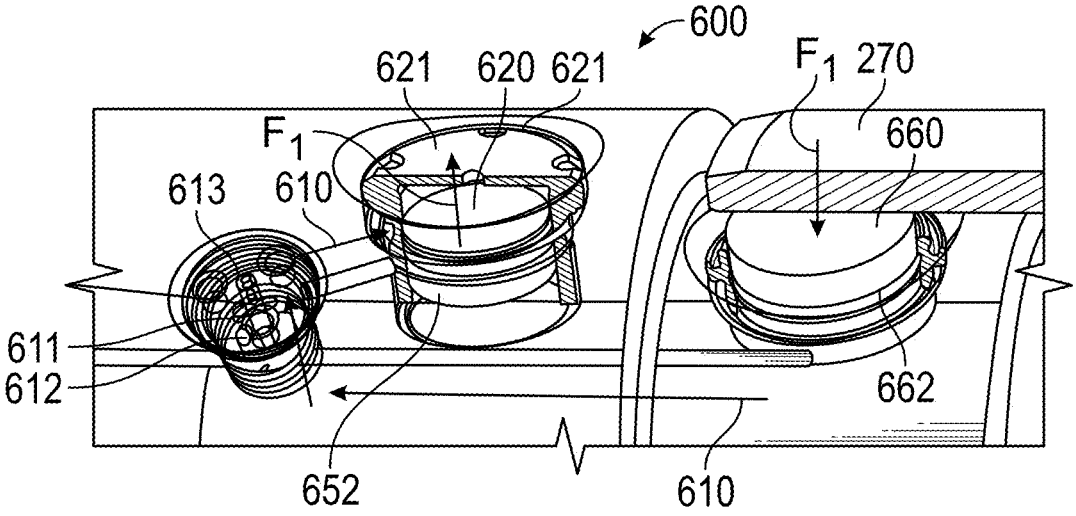
FIGS. 6A and 6B show certain details of a dampener, such as the dampener shown in FIGS. 2-5 to reduce or control the rate of the tilt of the drilling assembly.
Figure 6B:
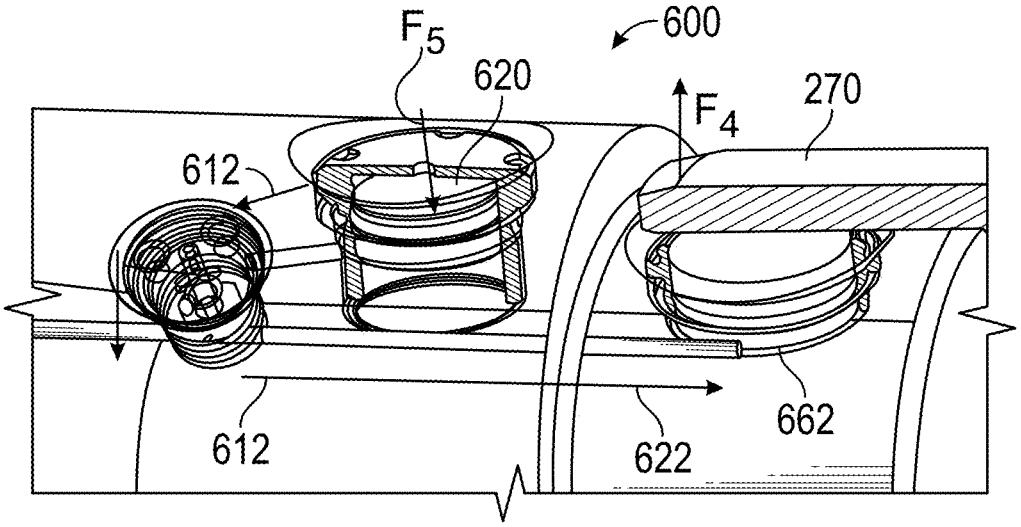

FIGS. 6A and 6B show certain details of the dampening device 600, which is the same as device 240 in FIGS. 2, 4 and 5. Referring to FIG. 2 and FIGS. 6A and 6B, when the housing 270 applies force F1 on the piston 660, it moves a hydraulic fluid (such as oil) from a chamber 662 associated with the piston 660 to a chamber 652 associated with a compensator 620, as shown by arrow 610. A restrictor 611 restricts the flow of the fluid from the chamber 662 to chamber 652, which increases the pressure between the piston 660 and the restrictor 611, thereby restricting or controlling the rate of the tilt. As the hydraulic fluid flow continues through the restrictor 611, the tilt continues to increase to the maximum level defined by the end inclination stop 280 shown and described in reference to FIG. 2. Thus, the restrictor 611 defines the rate of increase of the tilt. Referring to FIG. 6B, when force F1 is released from the housing 270, as shown by arrow F4, force F5 on compensator 620 moves the fluid from chamber 652 back to the chamber 662 of piston 660 via a check valve 612, bypassing the restrictor 611, which enables the housing 270 to move to its straight position without substantial delay. A pressure relief valve 613 may be provided as a safety feature to avoid excessive pressure beyond the design specification of hydraulic elements.

Thus, in aspects, the drilling assemblies described herein include a deflection device that: (1) provides a tilt when the drilling assembly is not rotated and the drill bit is rotated by a downhole drive, such as a mud motor, to allow drilling of curved or articulated borehole sections; and (2) the tilt automatically straightens when the drilling assembly is rotated to allow drilling of straight borehole sections. In one non-limiting embodiment, a mechanical force application device may be provided to initiate the tilt. In another non-limiting embodiment a hydraulic device may be provided to initiate the tilt. A dampening device may be provided to aid in maintaining the tilt straight when the drilling assembly is rotated. A dampening device may also be provided to support the articulated position of the drilling assembly when rapid forces are exerted onto the tilt such as during tool face fluctuations. Additionally, a restrictor may be provided to reduce or control the rate of the tilt. Thus, in various aspects, the drilling assembly automatically articulates into a tilted or hinged position when the drilling assembly is not rotated and automatically attains a straight or substantially straight position when the drilling assembly is rotated. For the purpose of this disclosure, substantially rotationally stationary generally means the drilling assembly is not rotated by rotating the drill string 148 from the surface. The phrase "substantially rotationally stationary" and the term stationary are considered equivalent. Also, a "straight" section is intended to include a "substantially straight" section.

The foregoing disclosure is directed to the certain exemplary embodiments and methods. Various modifications will be apparent to those skilled in the art. It is intended that all such modifications within the scope of the appended claims be embraced by the foregoing disclosure. The words "comprising" and "comprises" as used in the claims are to be interpreted to mean "including but not limited to".

The invention claimed is:

1. An apparatus for drilling curved and straight sections of a wellbore, comprising:

a drilling assembly configured to include a drill bit at an end thereof that is rotatable by a drive in the drilling assembly, the drilling assembly further configured to be connected to a drill pipe that is rotatable from a surface location, wherein the drilling assembly further includes:

a shaft, wherein the shaft is coupled to the drive and the drill bit; and a housing comprising:

an upper section and a lower section;

a bearing section in the lower section that rotatably couples the shaft to the lower section; and a pivot member between the upper section and the lower section that couples the upper section to the lower section, wherein the lower section tilts relative to the upper section about the pivot member when the drill pipe is rotationally stationary to allow drilling of a curved section of the wellbore;

wherein the shaft is disposed and configured to be rotated by the drive within the upper section, the lower section, the bearing section, and the pivot member;

wherein rotating the drill pipe causes a reduction of the tilt between the upper section and the lower section when the drill pipe is rotated to allow drilling of a straighter section of the wellbore.

2. The apparatus of claim 1, further comprising an end stop that limits the tilt to a selected angle.

3. The apparatus of claim 1, wherein the lower section tilts about the pivot member within a selected plane, and wherein the pivot member is selected from a group consisting of: (i) a pin; and (ii) a ball joint.

4. The apparatus of claim 1, further comprising a force application device configured to initiate the tilt.

5. The apparatus of claim 4, wherein the force application device is selected from a group consisting of: (i) a spring that applies a force on the lower section; and (ii) a hydraulic device that applies a force on the lower section in response to a pressure differential.

6. The apparatus of claim 1, wherein the pivot member has a pivot axis located off a longitudinal axis of the drilling assembly to initiate the tilt when an axial load is applied on the drilling assembly.

7. The apparatus of claim 1, further comprising a dampener for reducing a rate of the tilt.

8. The apparatus of claim 7, wherein the dampener reduces variation of the tilt when the drill pipe is rotationally stationary.

9. The apparatus of claim 1, wherein the drilling assembly further includes a stabilizer that is selected from a group consisting of: (i) a stabilizer below the pivot member; (ii) a stabilizer above the pivot member; and (iii) a stabilizer below the pivot member and a stabilizer above the pivot member.

10. A drilling assembly configured to be connected to a drill pipe and to include a drill bit at an end thereof and a drive for rotating the drill bit for drilling curved and straight sections of a wellbore, the drilling assembly comprising:

a shaft, wherein the shaft is coupled to the drive and the drill bit;

a housing comprising:

an upper section and a lower section;

a bearing section in the lower section that rotatably couples the shaft to the lower section;

pivot member between the upper section and the lower section that couples the upper section to the lower section, wherein the lower section tilts relative to the upper section about the pivot member when the drill pipe is rotationally stationary to allow drilling of a curved section of the wellbore, wherein the shaft is disposed and configured to be rotated by the drive within the upper section, the lower section, the bearing section, and the pivot member;

wherein rotating the drill pipe reduces the tilt between the upper section and the lower section to allow drilling of a straighter section of the wellbore; and a dampener that reduces a rate of the tilt.

11. The drilling assembly of claim 10 further comprising a force application device that exerts a force on the lower section to initiate the tilt.

12. The drilling assembly of claim 11 further comprising a stabilizer that aids in initiating the tilt when the drill pipe is rotationally stationary and the drill bit is rotated by the drive.

13. A method of drilling a wellbore, comprising:

conveying a drilling assembly into the wellbore by a drill pipe from a surface location, the drilling assembly including:

a drill bit at an end thereof that is rotatable by a drive in the drilling assembly;

a shaft, wherein the shaft is coupled to the drive and the drill bit;

a housing comprising:

an upper section and a lower section;

a pivot member between the upper section and the lower section that couples the upper section to the lower section, wherein the lower section tilts relative to the upper section about the pivot member when the drill pipe is rotationally stationary to allow drilling of a curved section of the wellbore, wherein the shaft is disposed and configured to be rotated by the drive within the upper section, the lower section, the bearing section, and the pivot member;

wherein rotating the drill pipe reduces the tilt between the upper section and the lower section to allow drilling of a straighter section of the wellbore;

maintaining the drill pipe rotationally stationary to enable the lower section to tilt relative to the upper section about the pivot member; and rotating the drill bit by the drive to drill the curved section of the wellbore.

14. The method of claim 13 further comprising: (i) rotating the drill pipe to reduce the tilt; and (ii) drilling the straighter section of the wellbore by applying weight on the drill bit.

15. The method of claim 13 further comprising limiting the tilt to a selected angle during drilling of the curved section via an end stop.

16. The method of claim 13 further comprising providing a dampener that reduces a rate of the tilt when the drill pipe is rotationally stationary.

17. The method of claim 13 further comprising applying a force via a force application device on the lower section to initiate the tilt when the drill pipe is rotationally stationary.

18. The method of claim 17, wherein the force application device is selected from a group consisting of: (i) a spring that applies a force on the lower section; and (ii) a hydraulic device that applies a force on the lower section in response to a pressure difference.

19. The method of claim 13 further comprising providing a stabilizer that is selected from a group consisting of: (i) a stabilizer below the pivot member; (ii) a stabilizer above the pivot member; and (iii) a stabilizer below the pivot member and a stabilizer above the pivot member.

20. The method of claim 13 wherein the pivot member allows the lower section to tilt within a selected plane.

21. A drilling assembly configured to be rotated in a wellbore from a surface location by rotating a drill pipe coupled thereto, the drilling assembly comprising:

a drive for rotating a drill bit;

a shaft, wherein the shaft is coupled to the drive and the drill bit; and a housing comprising:

an upper section and a lower section;

a bearing section in the lower section that rotatably couples the shaft to the lower section; and a pivot member that couples the upper section to the lower section, wherein the lower section tilts relative to the upper section about the pivot member when the drill pipe is rotationally stationary to allow drilling of a curved section of the wellbore, wherein the shaft is disposed and configured to be rotated by the drive within the upper section, the lower section, the bearing section, and the pivot member;

wherein rotating the drill pipe reduces the tilt between the upper section and the lower section to allow drilling of a straighter section of the wellbore.

* * * * *